US007325472B2

(12) United States Patent
Ishihara

(10) Patent No.: US 7,325,472 B2
(45) Date of Patent: Feb. 5, 2008

(54) FILM CUTTING DEVICE

(75) Inventor: Hisamitsu Ishihara, Tokyo (JP)

(73) Assignee: Tokyo Automatic Machinery Works, Ltd., Tokyo (JP)

( * ) Notice: Subject to any disclaimer, the term of this patent is extended or adjusted under 35 U.S.C. 154(b) by 100 days.

(21) Appl. No.: 10/542,011

(22) PCT Filed: Jan. 15, 2004

(86) PCT No.: PCT/JP2004/000225

§ 371 (c)(1),
(2), (4) Date: Jul. 12, 2005

(87) PCT Pub. No.: WO2004/062859

PCT Pub. Date: Jul. 29, 2004

(65) Prior Publication Data

US 2006/0096430 A1 May 11, 2006

(30) Foreign Application Priority Data

Jan. 15, 2003 (JP) ..... 2003-007141

(51) Int. Cl.
*B26D 1/38* (2006.01)

(52) U.S. Cl. ..... 83/341; 83/349; 83/595

(58) Field of Classification Search ..... 83/341, 83/349, 37, 542, 595, 596, 355
See application file for complete search history.

(56) References Cited

U.S. PATENT DOCUMENTS 3,143,016 A 8/1964 Obenshainm
3,196,724 A 7/1965 Frank
4,356,745 A * 11/1982 Hornung et al. ..... 83/341
2003/0079593 A1* 5/2003 De Torre ..... 83/582

FOREIGN PATENT DOCUMENTS

| | | | |
|---|---|---|---|
| DE | 43 36 955 A1 | | 5/1995 |
| EP | 1197305 | * | 4/2002 |
| JP | 53121573 | | 9/1978 |
| JP | 58041018 | | 3/1983 |
| JP | 61230826 | * | 10/1986 |

(Continued)

OTHER PUBLICATIONS

European Search Report for corresponding Application No. EP 04 70 2418 PCT/JP2004000225 dated Sep. 3, 2007.

*Primary Examiner*—Stephen Choi
(74) *Attorney, Agent, or Firm*—Bell, Boyd & Lloyd LLP

(57) ABSTRACT

A fixed cutter is provided on a top surface of an adsorption type carrying belt that carries a film. A cylindrical cutter holder having a rotary cutter is provided in the vicinity of the fixed cutter. The fixed cutter has nearly a triangular cross section, and includes an inclined surface that guides the film on the top surface of the belt to a blade edge and a flank relief having nearly a V-shaped cross section. A blade edge of the rotary cutter is disposed at an offset position. The film is cut by a relative operation of the blade edges while rotating the rotary cutter with respect to the fixed cutter. Both of the cutters are installed in a cutter unit, and are fixed to a frame part of a packaging machine while performing positional adjustment.

8 Claims, 8 Drawing Sheets

FOREIGN PATENT DOCUMENTS

| | | |
|---|---|---|
| JP | 239896 | 3/1990 |
| JP | 3184797 | 8/1991 |
| JP | 3103200 | 10/1991 |
| JP | 04040254 | 2/1992 |
| JP | 460696 | 5/1992 |
| JP | 5146991 | 6/1993 |
| JP | 5177586 | 7/1993 |
| JP | 10015887 | 1/1998 |
| JP | 10-236409 | 9/1998 |
| JP | 2002211833 | 7/2002 |
| WO | 00/61325 | 10/2000 |

* cited by examiner

FILM CUTTING DEVICE

TECHNICAL FIELD

The present invention relates to a film cutting device used to cut a film carried by a conveying means, such as a conveyer, in order to package goods, such as various articles of merchandise.

BACKGROUND ART

Generally, devices disclosed in Japanese Unexamined Utility Model Application Publication No. S53-121573, Japanese Examined Patent Application Publication No. H2-23412, Japanese Unexamined Patent Application Publication No. H4-40254, Japanese Unexamined Patent Application Publication No. H10-15887, and Japanese Unexamined Patent Application Publication No. 2002-211833 can be mentioned as examples of this type of film cutting device. These film cutting devices are used to cut a continuous belt-like film into predetermined lengths while drawing the film from a roll, so as to package various articles of merchandise with the film.

Japanese Unexamined Utility Model Application Publication No. S53-121573 relates to a thin-paper rotary cutting device comprised of convex blades and flat receiving blades, in which the convex blade is formed to have a concavely curved shape, and cuts a thin sheet of paper in a state of being slightly inclined with respect to the flat receiving blade, thereby making its blade touching uniform.

Japanese Examined Patent Application Publication No. H2-23412 relates to a device for cutting a film with a cutting knife provided on an adsorption drum and with a rotary opposed knife while winding the film drawn out on the adsorption drum, in which neither jamming nor a positional deviation occurs when the film is cut, because the film is cut in the state of being adsorbed onto the adsorption drum.

As in Japanese Examined Patent Application Publication No. H2-23412, Japanese Unexamined Patent Application Publication No. H4-40254 relates to a device in which a film is cut while winding the film on a roller, so that neither jamming nor a positional deviation occurs when the film is cut.

Japanese Unexamined Patent Application Publication No. H10-15887 relates to a cutting device in which a lower blade of a rotary cutter is caused to depart from a position to butt against an upper blade and is elastically deformed when a sheet of paper or the like is cut, so that a cutting operation is performed with the lower and upper blades by means of an elastic return force generated by the toughness of the lower blade.

Japanese Unexamined Patent Application Publication No. 2002-211833 relates to a device for cutting a narrow tear tape being fed to packaging sheets, in which a slope cutter that serves as a receiving blade is provided at the middle of a conveying adsorption belt that conveys a tape, and the time during which a tape is not adsorbed is shortened by cutting the tape in the vicinity of a film-conveying plane that meets the tape, thereby preventing the tape from being crumpled so that the tape can be conveyed straight.

However, with regard to the film cutting device mentioned above, that of Japanese Unexamined Utility Model Application Publication No. S53-121573 has a disadvantage in that the convex blade cannot be easily formed to have a concavely curved shape, and it is difficult to adjust the blade butting between the convex blade and the flat receiving blade. That of Japanese Examined Patent Application Publication No. H2-23412 and that of Japanese Unexamined Patent Application Publication No. H4-40254 have a disadvantage in that the adsorbing device must be provided not only on the conveying belt but also on the adsorption roller, and the film is wound on the adsorption roller and is drawn out toward the deflection roller, thus increasing the number of rollers and producing a complex, high-cost device. That of Japanese Unexamined Patent Application Publication No. H10-15887 has a disadvantage in that a blade-touching adjustment is difficult since the blade is elastically deformed by the toughness of the blade when a film or the like is cut.

That of Japanese Unexamined Patent Application Publication No. 2002-211833 is a device for cutting a narrow tear tape, and cannot cut a packaging film much wider than the tear tape with high precision. Especially when two blades are provided in a crossed manner, and a cutting edge of one of the two blades is butted against a cutting edge of the other blade so as to cut a film in point contact as if with a pair of scissors, a blade width becomes greater, and, unlike the tear tape, the width of the film to be cut becomes greater. Therefore, the cutting edge largely departs because of its blade toughness, and, disadvantageously, a precise cutting operation cannot be performed.

The present invention has been made in consideration of these circumstances, and aims to provide a film cutting device capable of easily performing a blade touching adjustment and capable of cutting any kind of film with high accuracy even if the film is wide.

DISCLOSURE OF INVENTION

The film cutting device according to the present invention is characterized in that the film cutting device includes a conveying means for conveying a film, a first cutter that is provided on the conveying means and that has a blade edge at an end of a guide surface inclined in a direction receding from the conveying means, and a second cutter that cuts a film placed on the guide surface in cooperation with the blade edge of the first cutter, and in that the first cutter and the second cutter are relativity moved, and the blade edge of the first cutter and a blade edge of the second cutter are gradually engaged with each other in an extending direction thereof, thus cutting the film.

A film carried by the conveying means can be cut in its width direction by being guided by the guide surface so as to be separated from the conveying means and by engaging the blade edge provided at the end of the guide surface of the first cutter and the blade edge of the second cutter with each other.

The conveying means is an adsorption type carrying belt that adsorbs the film.

Since the film being carried is adsorbed, film can be carried regardless of the difference in the kind of film, such as a difference in rigidity of the film or a difference in tension of the film. Moreover, the film can be sent to a film cutting position while smoothly separating the film from the adsorption type carrying belt along the guide surface.

The blade edge of the first cutter is elastically deformable, and the first cutter may be provided with a displacement restricting member that restricts an elastic deformation of the blade edge when the film is cut.

If the blade edge of the first cutter is elastically deformable by toughness or ductility, it is possible to absorb minute pressure-contact chaotic movement of the blade edge resulting from an error in dimension or an error in assemblage between both the first and second cutters when the blade edge of the first cutter cuts a film while being pressed to come into contact with the second cutter. In a case in which a wide film is cut, the distance of blade touching of the cutter becomes long when the cutter is pressed to come into contact with the other one, so that the blade edge deviates, and the sharpness of the cutter is reduced. However, according to the present invention, since the displacement restricting member restricts the deviation of the blade edge of the first cutter, the sharpness of the cutter can be maintained, and the film can be cut with high accuracy.

Instead of the first cutter, or, alternatively, together with the first cutter, the blade edge of the second cutter may be formed to be elastically deformable by toughness, and the second cutter may be provided with a displacement restricting member.

The first cutter may be shaped like a wide band, and the displacement restricting member may be provided in a central area in an extending direction of the blade edge of the first cutter.

If the film, which is a sheet of material, is wide, the first and second cutters must be formed to be wide, and, when the first and second cutters cut the film while being pressed against each other, the first and second cutters are greatly deformed because of their toughness or ductility at their central areas. In this case, the amount of deviation of the entire blade edge resulting from the toughness can be restricted by providing the displacement restricting member in the central area in the extending direction of the blade edge of the first cutter.

The displacement restricting member may be in contact with a flank relief of the first cutter that is crossed with the guide surface at the blade edge thereof.

The deviation of the blade edge due to toughness occurring when the cutters are pressed against each other can be controlled by bringing the displacement restricting member into contact with the flank relief of the first cutter.

The second cutter is a rotary cutter rotatable around a rotational shaft, and the blade edge of the second cutter may be installed so that a cutting force acts toward the first cutter when a film is cut.

If a cutting force acts toward the first cutter at all steps performed when a film is cut, it is possible to absorb minute pressure-contact chaotic movement of the blade edge resulting from an error in dimension or an error in assemblage between both the first and second cutters. Therefore, it is recommended to dispose the second cutter at an offset position.

The second cutter may guide the following film in a direction of the conveying means by use of a backface of the second cutter on a rear side in a moving direction subsequent to the blade edge thereof.

After cutting the film through a relative operation of the blade edges of the first and second cutters, a film part following the film that has been cut is pressed down by the backface of the second cutter. Thereby, the film part can be guided onto the conveying means positioned in front of the first cutter.

The first and second cutters are held together as a cutter unit, and can be adjusted by being detached from the conveying means.

Since an engagement position of the first and second cutters can be independently adjusted in a state in which the cutters are separated from the conveying means, it is possible to perform excellent maintenance of the positioning of the blade edges or replacement of constituent elements.

The cutter unit may be disposed so as to be adjustably positioned in the direction in which the film is carried by the conveying means.

Since the position at which the film being carried by the conveying means is cut can be adjusted in forward and backward directions, the whole of the device can be made compact so as to be superior in size reduction and in economy, and a cutting adjustment can be easily performed according to a difference in kind or usage of the film.

BEST MODE FOR CARRYING OUT THE INVENTION

Preferred embodiments of the present invention will be hereinafter described with reference to the drawings. It should be noted that the present invention is not limited to the embodiments described below, and, as an example, constituent elements of these embodiments may be appropriately combined.

Figure 1:
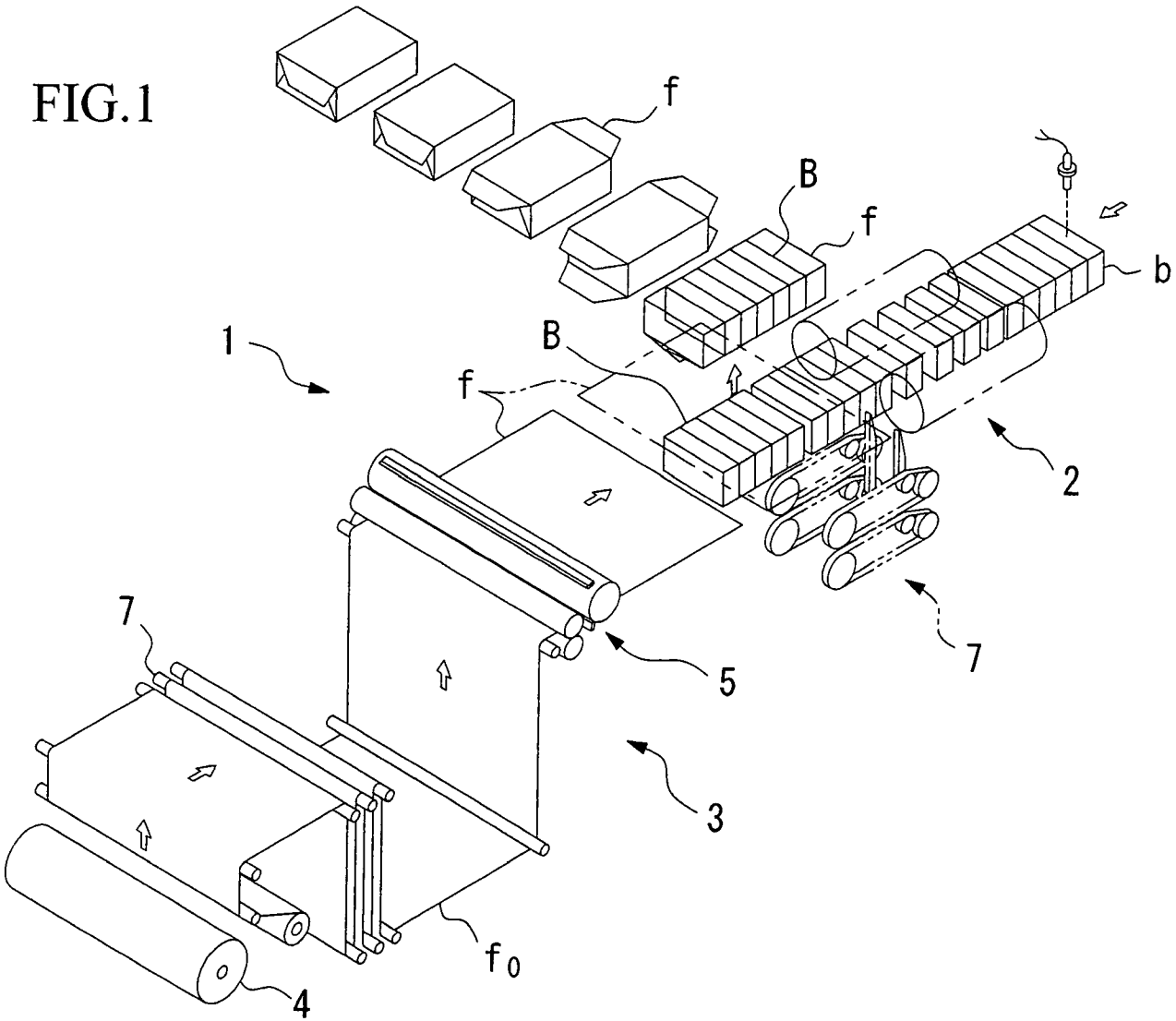
FIG. 1 is a perspective view that roughly explains a process for gathering goods into accumulation units and packaging each unit in an accumulating and packing machine including a film cutting device according to the embodiment of the present invention.
Figure 2:
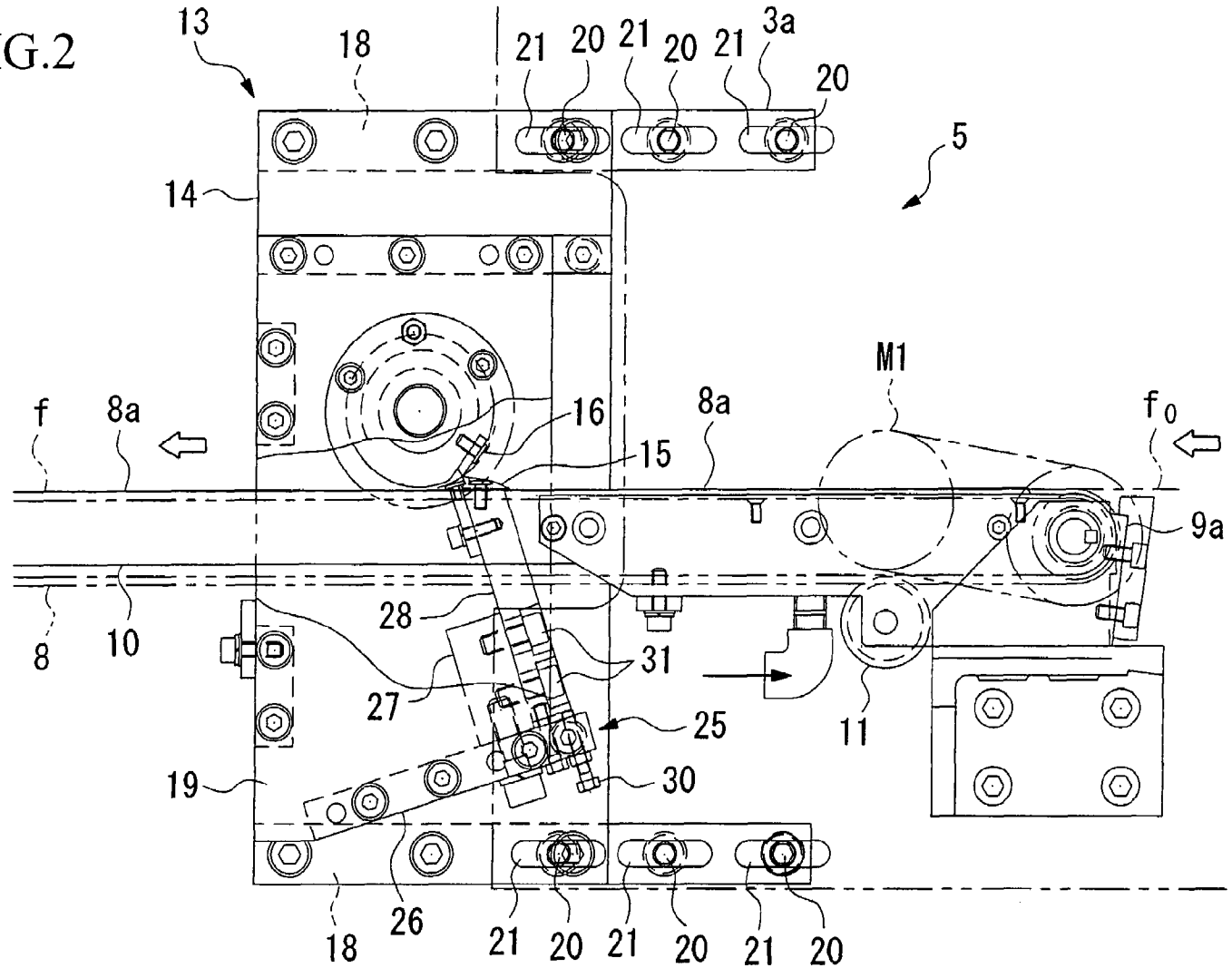
FIG. 2 is a front view of the film cutting device.
Figure 3:
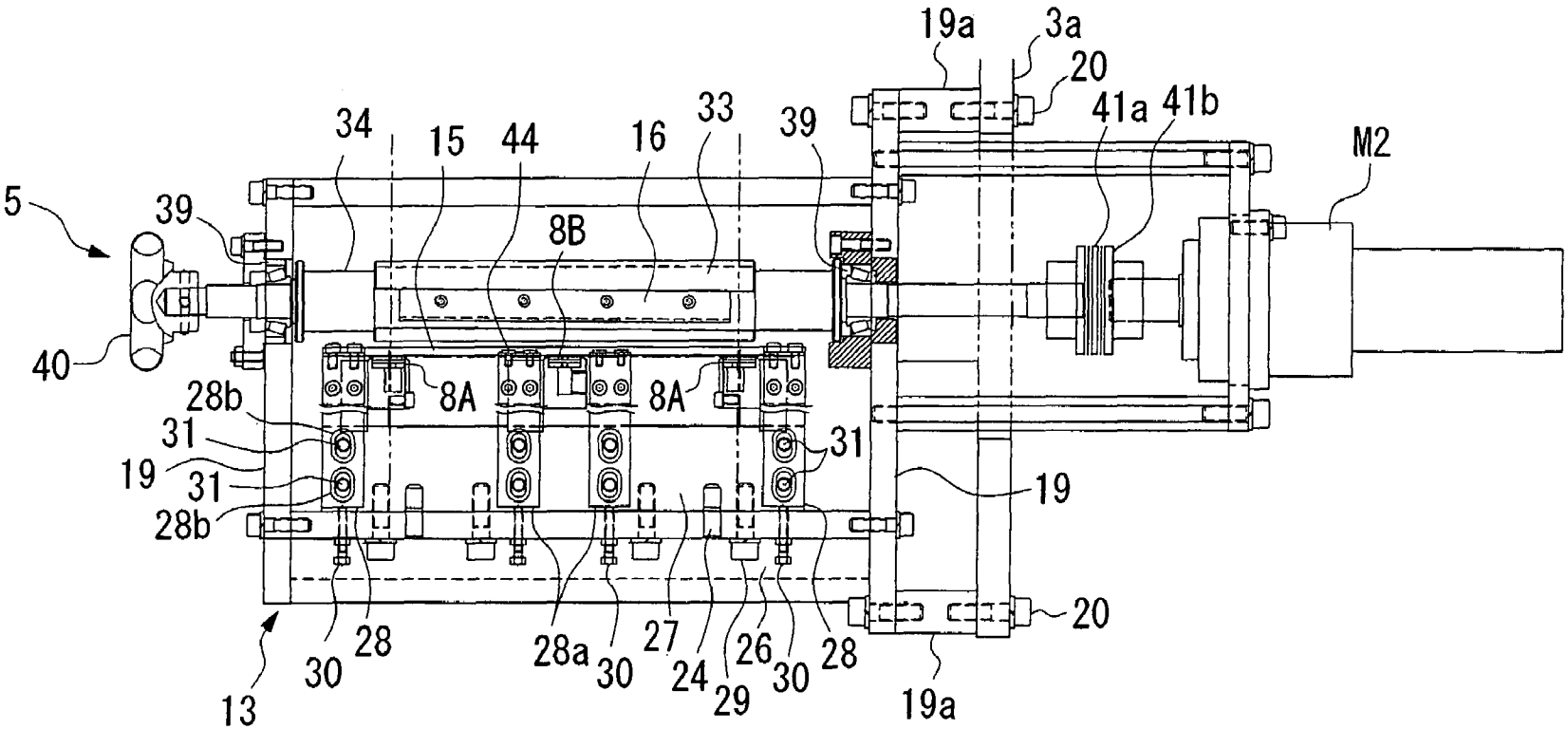
FIG. 3 is a right side view of the film cutting device of FIG. 2.
Figure 4:
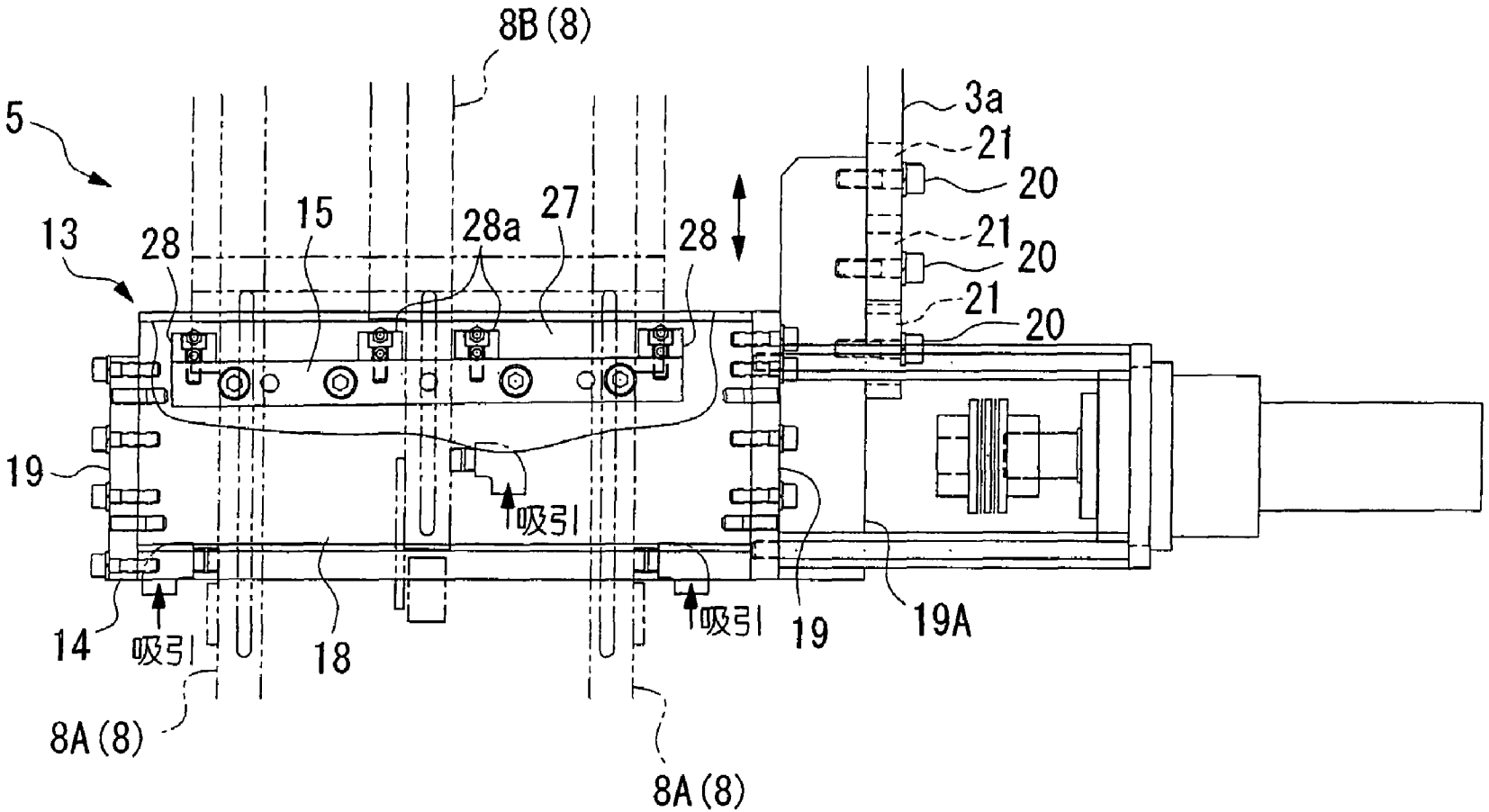
FIG. 4 is a plan view of the film cutting device of FIG. 2 in which a rotary cutter is omitted.
Figure 5:
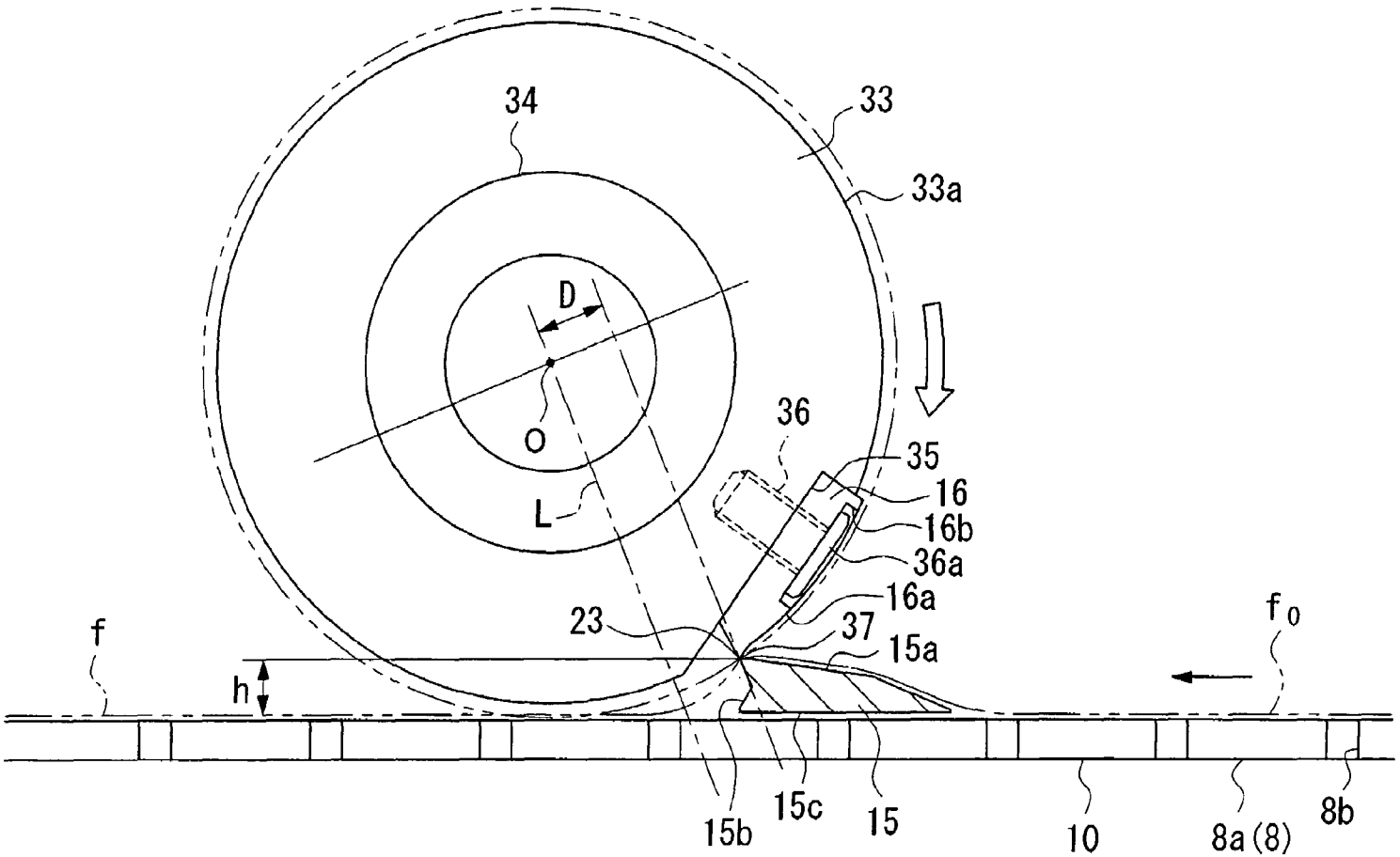
FIG. 5 is an enlarged view of a fixed cutter and a rotary cutter of a cutter unit.
Figure 6:
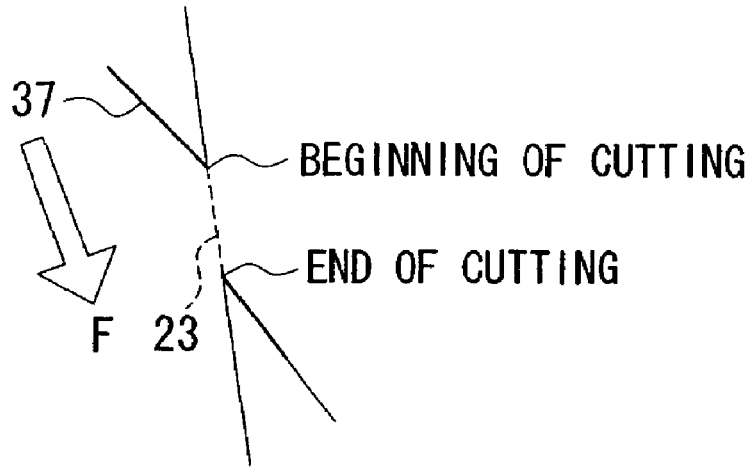
FIG. 6 is a schematic view showing a cutting step performed by the fixed cutter and the rotary cutter.
Figure 7:
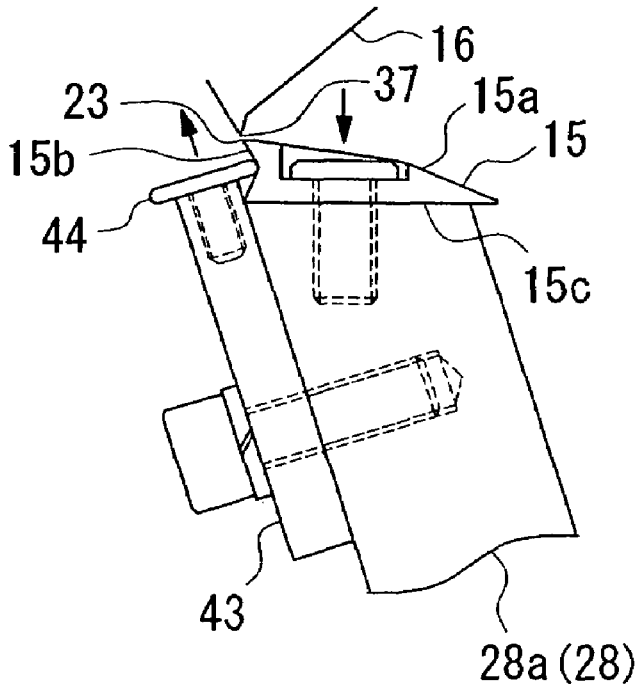
FIG. 7 is an explanatory drawing that explains the fixed cutter and a vibration preventing hook.

Referring now to FIG. 1 to FIG. 7, a film cutting device according to an embodiment of the present invention will be described. FIG. 1 is a perspective view that roughly explains a process for gathering goods into accumulation units and packaging each unit in an accumulating and packing machine including the film cutting device, FIG. 2 is a front view of the film cutting device, FIG. 3 is a right side view of the film cutting device of FIG. 2, FIG. 4 is a plan view of the film cutting device of FIG. 2 in which a rotary cutter is omitted, FIG. 5 is an enlarged view of a fixed cutter and a rotary cutter of a cutter unit, FIG. 6 is a schematic view showing a cutting step performed by the fixed cutter and the rotary cutter, and FIG. 7 is an explanatory drawing that explains the fixed cutter and a vibration preventing hook.

The accumulating and packing machine 1 shown in FIG. 1 is to package goods with a packaging material, such as a plastic film f. For example, the goods are a rectangular solid-shaped box, such as a tissue box (hereinafter, referred to simply as "box") b, and an appropriate number of boxes (e.g., five boxes) arranged in close contact with each other are packaged as a unit (i.e., an accumulation unit B).

A packaging process is performed by the accumulating and packing machine 1 as follows. First, boxes b sequentially produced are arranged in the same direction while being brought into close contact with each other, and are carried by an accumulating and conveying machine 2. Thereafter, in a conveying step, adjoining boxes b are spaced at predetermined intervals, and five boxes are brought into contact with each other so as to form an accumulation unit B. Thereafter, each accumulation unit B consisting of five boxes is sent upward.

On the other hand, in a packaging machine 3, a plastic film fo, which is made of, for example, polyethylene and which is wound on a roll 4, is drawn from the roll 4, and is cut into predetermined lengths by a film cutting device 5. A rising accumulation unit B is then placed against a film f cut thereby from below, and is packaged with the film f in a body folding manner. Thereafter, the accumulation unit B is sealed by subjecting the ends of the film f to, for example, thermo-compression bonding.

A description will be hereinafter given of the film cutting device 5 that cuts a continuous band-shaped film fo having a width of, for example, about 780 mm into predetermined lengths in the accumulating and packing machine 1 having the step of accumulating the boxes b and the step of packaging the boxes b with the film f.

The packaging machine 3 of FIG. 1 is disposed on an extension of a flat belt conveyer of the accumulating and conveying machine 2 carrying the boxes b in such a way as to substantially face the accumulating and conveying machine 2. The film fo drawn out from the roll 4 is fed to the film cutting device 5 from a guide roll via a dancer roller 7.

In the film cutting device 5 shown in FIGS. 2 to 4, an adsorption type carrying belt (conveying means) 8 used to place and carry the film fo thereon is extended to above the flat belt conveyer of the accumulating and conveying machine 2 of the boxes b so as to overlap with the flat belt conveyer. The adsorption type carrying belt 8 is formed being wound endlessly between a pair of driving rollers 9*a* and 9*b* provided on both sides in the conveying direction. The driving roller 9*a*, which is one of the two rollers, receives a driving force of a motor M1, thereby orbitally moving the adsorption type carrying belt 8. For example, the adsorption type carrying belt 8 is made up of two endless belts 8A and 8A disposed on both ends in the width direction of the film fo and one (or more) endless belt 8B (see FIG. 4) disposed between the belts 8A and 8A.

A long adsorption box 10 is provided at the lower side of a top surface 8*a* of the adsorption type carrying belt 8 that is extended in the conveying direction of the film fo, and the adsorption box 10 is brought into contact with the top surface 8*a* of the belt by means of a pressing roller 11. Since through-holes 8*b* are bored in the adsorption type carrying belt 8 at predetermined intervals upward and downward, the film fo is carried while being adsorbed by the top surface 8*a* of the belt (see FIG. 5).

A cutter unit 13 that cuts the film fo into predetermined lengths is disposed on a middle part in the conveying direction of the adsorption type carrying belt 8. The cutter unit 13 has a frame 14 extending from above the adsorption type carrying belt 8 downward and extending in the width direction. The frame 14 holds a fixed cutter 15 and a rotary cutter 16 both of which cut the film fo through their relative operation.

The frame 14 has a pair of horizontal frame parts 18, which are disposed perpendicularly to the conveying direction on both the upper and lower sides of the adsorption type carrying belt 8, and a pair of side frame parts 19, which are disposed vertically on both the outsides in the width direction of the adsorption type carrying belt 8 and which are connected to both ends of the horizontal frame parts 18. As shown in FIGS. 3 and 4, one (or both) of the side frame parts 19 is fixed to a main frame 3*a* of the packaging machine 3 that extends in the extending direction of the adsorption type carrying belt 8 with one or more fixing members 20, such as bolts, through an intermediary member 19*a*. Each bolt 20 is fixed to the side frame 19 through each long hole 21 bored in the main frame 3*a*. Within the range of each long hole 21, the fitting position of the cutter unit 13 can be adjusted in the forward and backward directions in which the adsorption type carrying belt 8 extends.

The fixed cutter 15 is slightly spaced apart from and floats above the top surface 8*a* of the adsorption type carrying belt 8 especially as shown in FIG. 5. An inclined surface (guide surface) 15*a*, which is a top surface of the fixed cutter 15, gradually recedes from the top surface 8*a* of the belt 8 from the upstream side to the downstream side of the top surface 8*a*, and has a substantially triangular longitudinal section. As shown in FIG. 5, the inclined surface 15*a* is formed as a two-step inclined surface, and the oblique angle of the inclined surface on the downstream side is smaller than that on the upstream side. The fixed cutter 15 extends in the width direction of the adsorption type carrying belt 8, and is equal at least in width to the film fo. Therefore, the film fo is carried while being adsorbed by the top surface 8*a* of the belt 8, is then scooped by the fixed cutter 15 along the inclined surface 15*a*, and is carried in the direction receding from the top surface 8*a* of the belt 8.

In the fixed cutter 15, a crossed ridge line between an end on the downstream side of the inclined surface 15*a* and a flank relief (i.e., a recess) 15*b* facing the downstream direction of the top surface 8*a* of the belt 8 serves as a straight blade edge 23 extending in the width direction of the top surface 8*a* of the belt 8. The blade edge 23 is set at a low height h (e.g., about 3 to 5 mm) from the top surface 8*a* of the belt 8. For example, the flank relief 15*b* has a runaway groove shaped substantially like the letter V or like a concave curve when viewed as a longitudinal section. Therefore, the wedge angle of the blade edge 23 formed by the inclined surface 15*a* and the flank relief 15*b* is set to be acute (alternatively, it is permissible for it to be obtuse). As a result, when the film fo is cut, the blade edge 23 receives a load of the rotary cutter 16 through a mutual operation with the rotary cutter 16, and can exhibit ductility (i.e., toughness) by which the blade edge 23 is elastically deformed.

Since the flank relief 15*b* is formed to have a runaway groove or since the wedge angle is set to be acute, minute pressure-contact chaotic movement of the blade edge 23 caused by an error in dimension or an error in assemblage can be absorbed by its toughness when the fixed cutter 15 cuts a film in cooperation with the rotary cutter 16.

As shown in FIGS. 2 and 3, the fixed cutter 15 is fixed between the side frames 19 and 19 of the cutter unit 13 through a supporting arm part 25. The supporting arm part 25 is made up of a first base 26, a second base 27, and arm parts 28. In detail, the first base 26 shaped substantially like a plate is fixed between the pair of side frames 19 and 19 in a state of being inclined obliquely upward, and the second base 27 is fixed with, for example, a screw in a state of being directed upward and being substantially perpendicular to the first base 26. The plurality of arms 28 (four arms 28 in FIG. 3) are attached to the second base 27 at predetermined intervals in the width direction of the top surface 8*a* of the belt 8 so as to be movable forward and backward in its longitudinal direction. The bottom 15*c* of the fixed cutter 15 is attached to the front end surface of each arm 28 directed upward.

In the supporting arm part 25, a positioning pin 24 that determines the crossed position of the second base 27 with respect to the first base 26 is provided at a connected portion between the first base 26 and the second base 27, and the first and second bases 26 and 27 are fixed together with a bolt 29 or the like. A blade-touching adjustment bolt (blade touching adjustment member) 30 that passes through the first base 26 and that presses the rear end surface of each arm 28 is screwed to the first base 26. The blade touching of the fixed cutter 15 through each arm 28 can be adjusted by rotating and moving back and forth the blade-touching adjustment bolt 30. Each arm 28 has a long hole 28*b*, and is fixed to the second base 27 with a fixing bolt 31 or the like so that the arm 28 can move to or from the second base 27 through the long hole 28*b*.

Therefore, the blade-touching adjustment bolt 30 is moved back and forth in a state in which each fixing bolt 31 is loosened, and the blade edge 23 of the fixed cutter 15 is moved back and forth through each arm 28, thus adjusting the blade touching.

As shown in FIG. 5, the rotary cutter 16 is disposed on an outer peripheral surface 33*a* of a rotatable cylindrical cutter holder 33 along a rotational shaft 34. The cutter holder 33 is disposed above the top surface 8*a* of the belt 8 in such a way so as to have a slight gap therebetween and so as to face the fixed cutter 15. A concave part 35 whose cross section is shaped like the letter L is formed in the outer peripheral surface 33*a* of the cutter holder 33 along the rotational shaft 34. The rotary cutter 16 is fixed to the concave part 35 with, for example, a bolt 36 substantially perpendicular to the radius line of the cutter holder 33 (i.e., substantially in the direction of a tangential line of the outer peripheral surface 33*a*).

The rotary cutter 16 is shaped substantially like a plate extending in the width direction of the adsorption type carrying belt 8. A convex curved surface. (backface) 16*a*, which is an upper surface of the rotary cutter 16, slightly juts out from the outer peripheral surface 33*a*, and is convexly curved along the outer peripheral surface 33*a*. A head 36*a* of the bolt 36 is placed onto a concave groove 16*b* hollowed toward the rotational shaft 34 of the cutter holder 33 from the convex curved surface 16*a*, thereby sinking inward from the convex curved surface 16*a*.

In the rotary cutter 16, the ridge part ahead in the rotational direction of the convex curved surface 16*a* serves as a blade edge 37. For example, the blade edge 37 is straight extending in the width direction of the adsorption type carrying belt 8, and is longer than the width of the film fo, and is installed in a cutter-crossed manner in which the cutters are relatively inclined so that the blade edge 37 can be crossed with the blade edge 23 of the fixed cutter 15 at a predetermined angle. The blade edge 37 of the rotary cutter 16 is disposed at an offset position deviated by a distance D behind in the rotational direction from the rotational center O of the cutter holder 33 with respect to a virtual reference line L drawn substantially in parallel with the forward and backward direction of the blade edge 23 of the fixed cutter 15.

Therefore, when the cutter holder 33 is rotated around the rotational shaft 34 so as to rotate the rotary cutter 16, the blade edge 37 of the rotary cutter is pressed against the blade edge 23 of the fixed cutter 15, for example, from one of the ends of the blade edge 37, and is brought into point contact therewith at the beginning of cutting as shown in FIG. 6. In proportion to an advance in the rotation of the blade edge 37, a contact point between the blade edges 37 and 23 moves gradually, and the other end of the blade edge 37 is reached to come to the end of cutting. Therefore, the fixed cutter 15 and the rotary cutter 16 perform a scissors-like cutting operation.

Since the blade edge 37 of the rotary cutter 16 is offset by the distance D, a precise cutting operation can be performed by allowing a load F generated by the rotation of the blade edge 37 to act in a direction being pressed against the blade edge 23 which is a receiving blade from the beginning of cutting to the end of cutting. A rotation locus of the blade edge 37 is set to be greater than the convex curved surface 16*a* (see FIG. 5).

As shown in FIG. 3, the rotational shaft 34 extends to both sides of the cutter holder 33, and is rotatably supported by thrust bearings 39 and 39 provided on the side frames 19 and 19, respectively, and juts out therefrom. A blade-touching adjustment handle 40 is provided on one end of the rotational shaft 34. The blade edge 37 of the rotary cutter 33 can be adjusted so as to move radially back and forth from the inside of the cutter handle 33 by reversely and positively rotating the handle 40. A crossed angle of the blade edge 37 with the blade edge 23 can also be adjusted by reversely and positively rotating the handle 40.

A coupling part 41*a* is provided on the other end of the rotational shaft 34, and forms a coupling that transmits a driving force to the cutter holder 33 by coming into plane contact with a coupling part 41*b* connected to an output shaft of a cutter drive motor M2.

As shown in FIG. 3, the fixed cutter 15 is greater in length in the width direction of the adsorption type carrying belt 8 than the rotary cutter 16, and two arms 28 and 28 are provided on both ends in the lengthwise direction of the fixed cutter 15. Two arms 28 and 28 with an interval therebetween are also provided on the central part thereof. These are designated as central arm parts 28*a* and 28*a*, respectively. As shown in FIG. 7, a holding plate 43 is fixed to the side face of each central arm part 28*a* closer to the flank relief 15*b* of the fixed cutter 15 with, for example, a screw. For example, a planar vibration-preventing hook (displacement restricting member) 44 is fixed to the front end surface of the holding plate 43 while the front end surface of the hook 44 is being pressed against the runaway groove of the flank relief 15*b* of the fixed cutter 15. The vibration preventing hook 44 is omitted in FIG. 5.

The vibration preventing hook 44 can restrict runaway and twisting caused by elastic deformation resulting from the toughness of the blade edge 23 when the blade edge 37 of the rotary cutter 16 is pressed against the blade edge 23 of the fixed cutter 15 and performs a scissors-like cutting operation. Therefore, the film fo can be cut over its entire width while bringing the blade edge 37 and the blade edge 23 into point contact with each other. The vibration preventing hook 44 may be provided individually on each central arm part 28*a*, or a planar member formed integrally may be supported by the two central arm parts 28*a* and 28*a*.

Since the fixed cutter 15 is shaped like a long, thin, and planar band in order to cut the film fo and since both ends of the fixed cutter 15 are supported by the arms 28 and 28, especially the central part thereof is elastically deformed because of its toughness, and deviates from blade edge 37 of the rotary cutter 16, and is twisted, thus making it difficult to perform a scissors-like cutting operation in its central part. For example, if the blade edge 23 deviates by several microns because of toughness when the film fo is 20 μm in thickness, the film cannot be cut. In this embodiment, since the film cutting device is structured as above, a scissors-like cutting operation can be linearly performed while restricting deviation of the central part of the blade edge 23 and being gradually crossed with the blade edge 37 of the rotary cutter 16 over the entire length thereof.

The vibration preventing hook 44 may be brought into contact with the flank relief 15*b* over the whole length thereof.

The film cutting device 5 according to this embodiment is structured as described above. The operation of the film cutting device 5 will now be described.

First, only the cutter unit 13 is extracted before attaching the cutter unit 13 to the film cutting device 5, and the fitting position of the fixed cutter 15 is adjusted by the blade-touching adjustment bolt 30 of the supporting arm part 25. Likewise, the rotary cutter 16 is adjusted by the blade-touching adjustment handle 40. Thus, the positions of both the cutters are adjusted so that the blade edge 37 of the rotary cutter 16 rotating with respect to the blade edge 23 of the fixed cutter 15 can be moved in a state of being in point contact with each other and can perform a scissors-like cutting operation. Thereafter, the cutter unit 13 is passed between the adsorption type carrying belts 8 and 8, and is fixed to the frame part 3*a* of the packaging machine 3. At this time, the cutter unit 13 is fixed thereto by adjusting the position of the cutter unit 13 in the conveying direction of the adsorption type belt 8 by means of the bolt 20 and the long hole 21 of the frame part 3*a*.

Thereafter, a continuous band-shaped film fo is drawn out from the roll 4 of the packaging machine 3, and is carried to the top surface 8*a* of the adsorption type carrying belt 8 of the film cutting device 5. Since the film fo is adsorbed by the adsorption box 10 through the through-hole 8*b* on the top surface 8*a* of the belt 8, the film fo is carried without floating, regardless of the kind of the material of the film fo. When the film fo reaches the fixed cutter 15, the film fo is scooped by the gently inclined surface 15*a* over the whole width thereof, and is gradually separated from the top surface 8*a* of the belt 8 over the whole width thereof. The film fo then smoothly proceeds to the blade edge 23, which is the highest point to be reached by the film fo, in a state of a low parallel wave.

Since the fixed cutter 15 does not have a through-hole for adsorption in this embodiment, the effect of an adsorbing force by the adsorption box 10 is diminished, and the film fo naturally proceeds without tension even if the film fo is materially thin and limp. Moreover, a leakage negative pressure from the through-hole 8*b* of the belt 8 is slightly applied between the top surface of the inclined surface 15*a* and the back surface of the film fo, and a film-like air flow layer is partially generated, and, accordingly, the film fo is adsorbed to the inclined surface 15*a* by a slight force. Static electricity generated on the back surface of the film fo is removed from the inclined surface 15*a* into the packaging machine 3 by means of a static electricity removing device (not shown).

The film fo that has gone beyond the blade edge 23 is pressed against the adsorption type carrying belt 8 in front of the fixed cutter 15 by means of the outer peripheral surface 33*a* of the cutter holder 33. Thereafter, at a position where the cutter holder 33 has finished making one rotation, the blade edge 37 of the rotary cutter 16 comes into point contact with one end of the blade edge 23 of the fixed cutter 15, and starts cutting the film fo. Correspondingly to an advance in the rotation of the rotary cutter 16, the contact point between the blade edges 23 and 37 is moved in the direction in which the blade edge extends, and the end of cutting is reached (see FIG. 6), thus completely cutting the film fo.

Since the rotary cutter 16 is offset by the distance D, a load F generated by the rotation is imposed on the blade edge 23 from the beginning of cutting to the end of cutting. Additionally, since the flank relief 15*b* is shaped like the letter V or like a concave curved surface and since the wedge angle is set to be acute, an error in dimension of the cutters 15 and 16 or an error in attachment thereof is absorbed by the action of toughness, and the blade edge 23 of the fixed cutter 15 can reliably cut the film fo. Additionally, the vibration preventing hook 44 is pressed against the flank relief 15*b*, and the quantity of runaway due to toughness is restricted in the central part of the blade edge 23 of the fixed cutter 15 that is liable to run away more greatly because of toughness than the other part of the blade edge 23 since the blade edges 23 and 37 are great in width. Therefore, even when a wide film fo is cut by the fixed cutter 15 shaped like a thin planar band, the film fo can be cut over the whole width thereof with excellent sharpness and with high accuracy without causing a cutting bend or jamming.

The film fo following the cut plane of the film f is sent from the blade edge 23 of the inclined surface 15*a* of the fixed cutter 15, and is guided to the top surface 8*a* of the belt 8 ahead while the front end of the film fo is being pressed by the convex curved surface 16*a* following the blade edge 37 of the rotary cutter 16. Therefore, the front end of the film fo can be prevented from floating.

The film f that has been cut is carried above the accumulation unit B of the box conveying machine 2. The film f is then subjected to body folding by the rising movement of the accumulated boxes (i.e., accumulation unit) B, and packages the boxes B. In accordance with the conveyance of the film fo, the film fo is sequentially cut into a predetermined length per rotation of the rotary cutter 16, and the accumulation units B are sequentially packaged according to the process mentioned above.

The length of the film f can be adjusted by the rotational speed of the drive motors M1 and M2.

As described above, in the film cutting device 5 according to this embodiment, the cutter unit 13 is extracted outside from the film cutting device 5, and the blade touching of the blade edges 23 and 37 can be adjusted. Therefore, the blade touching thereof can be easily adjusted, and excellent maintenance is realized. Additionally, the film cutting device 5 can be reduced in size by the cutter unit 13, and excellent economy can be obtained. Additionally, since the cutting position can be easily changed on the adsorption type carrying belt 8, the film cutting device 5 is superior in replacing the kind of film with another.

Additionally, the film fo used for packaging that has a greater width than a tear tape can be cut with high accuracy according to the toughness of the blade edge 23, and, when a scissors-like cutting operation is performed, the blade edge 23 can be allowed to exhibit its toughness to such an extent as to compensate for errors in production, errors in installation, or errors in dimension, and the cutting operation can be prevented from being defectively performed because of excessive deviation of the blade edge 23. Additionally, since a film-like air flow layer is formed by a leakage negative pressure between the film fo moving along the inclined surface 15*b* of the fixed cutter 15 and the inclined surface 15*b*, the film fo can be smoothly carried to the blade edge 23 while weakening an adsorbing force.

Additionally, since the vibration preventing hook 44 is provided on the flank relief 15*b* of the fixed cutter 15, the blade edge 23 pushed by the blade edge 37 can be controlled not to deviate because of toughness when a scissors-like cutting operation is performed with the rotary cutter 16, and, even when the film fo having a great width of 780 mm is cut with the fixed cutter 15 shaped like a thin planar band, the film fo can be cut with excellent sharpness and with high accuracy over the entire width thereof without causing a cutting bend or jamming.

Additionally, the film fo can be reliably cut regardless of the kind of material of film fo. Moreover, since the film fo is carried and cut while being stably adsorbed, the film fo can be cut not only in a state of being placed horizontally but also in a state of being placed obliquely or being turned upside down. Therefore, a high degree of freedom can be obtained when the device is mounted into the machine.

Next, another embodiment of the present invention will be described. In this embodiment, the same reference characters as in the film cutting device 5 according to the aforementioned embodiment are given to the same or similar constituent parts or components, and description thereof is omitted.

Figure 8:
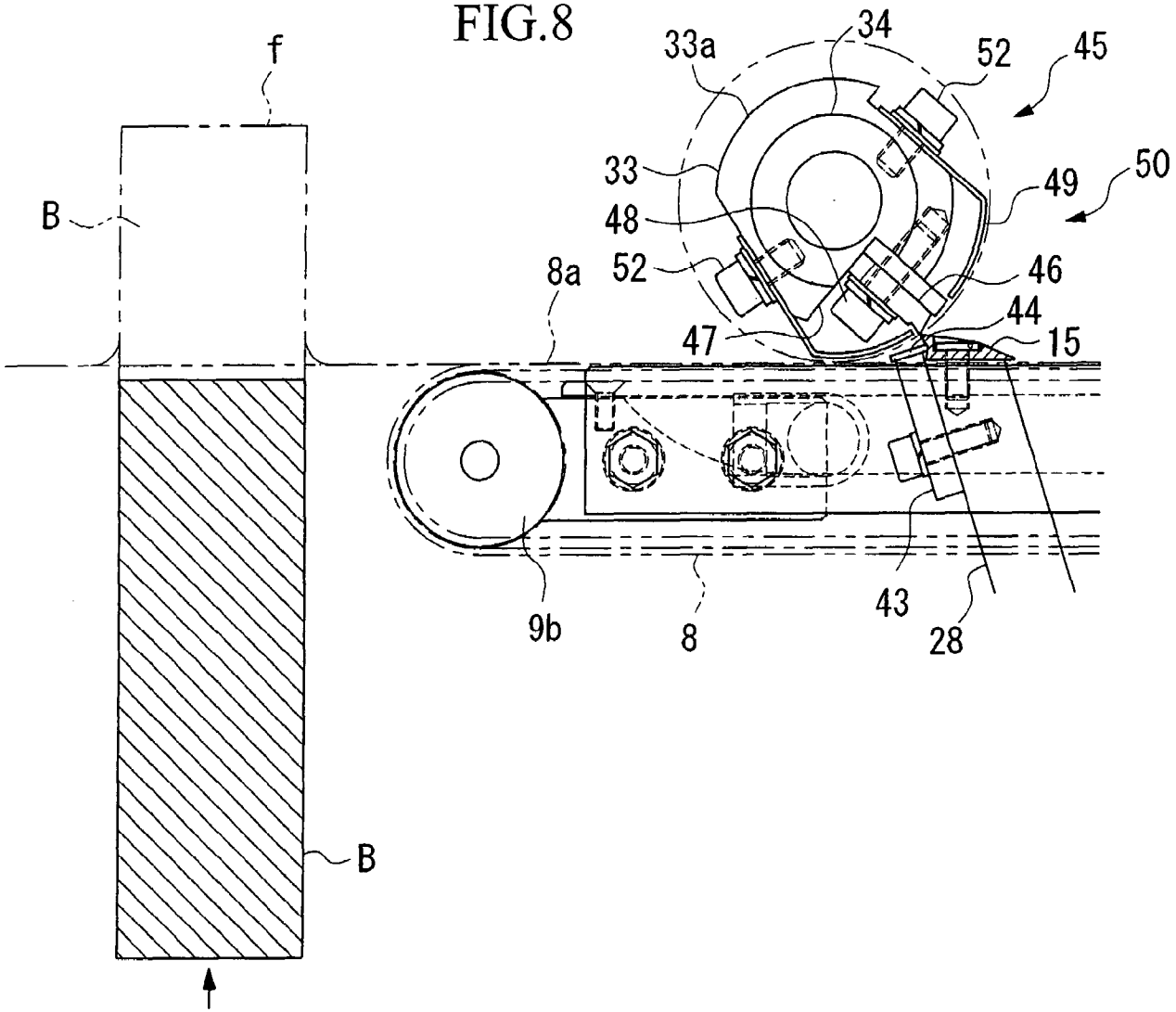
FIG. 8 is a front view showing a cutter unit of a film cutting device according to a second embodiment of the present invention and an adsorption type carrying belt.

FIG. 8 is a longitudinal section of a main part of a cutter unit of a film cutting device 45 according to a second embodiment of the present invention.

As shown in FIG. 8, in a cutter unit 50, a rotary cutter 46 is fixed with a fixing bolt 48 to an inner wall directed in a rotational direction in a substantially V-shaped concave part 47 formed in an outer peripheral surface 33*a* of a cylindrical cutter holder 33. A rotary cutter 46 that is substantially perpendicular to a rotational shaft 34 shown in FIG. 8 is fixed substantially in the radial direction when viewed sectionally, and a blade edge 37 juts out from the outer peripheral surface 33*a* of the cutter holder 33 and is held at the jutting out position.

The blade edge 37 of the rotary cutter 46 is disposed at an offset position deviated by a distance D behind in the rotational direction with respect to a virtual reference line L passing through the rotational shaft 34. The blade edge 37 of the rotary cutter 46 is held in a state of being slightly inclined with respect to a direction in which the blade edge 23 of the fixed cutter 15 extends, and the blade edge 37 performs a scissors-like cutting operation while being in point contact with the blade edge 23 of the fixed cutter 15 in accordance with the rotation of the rotary cutter 46.

It is permissible to install a guide member 49 that presses the film fo, which has been cut along the outer peripheral surface 33*a* before and behind the rotary cutter 46, against the top surface 8*a* of the belt 8. In this case, two opposite surfaces of the cylindrical cutter holder 33 may be excised, and both ends of the guide member 49 may be fixed with bolts 52 and 52, respectively.

A scissors-like cutting operation can be performed in relation to the fixed cutter 15 even when the rotary cutter 46 is disposed substantially in the radial direction as described above.

Additionally, the cutter unit 50 may be disposed in the vicinity of the driving roller 9*b* on the forward side in the conveying direction of the adsorption type carrying belt 8 as shown in FIG. 8. If so, an accumulation unit B of boxes b can be subjected to body folding and be packaged while being moved upward in the vicinity of the film f cut by the cutter unit 50, i.e., in the vicinity of the driving roller 9*b* on the forward side in the conveying direction of the adsorption type carrying belt 8. A more compact accumulating and packaging machine can be produced by employing this structure.

Figure 9:
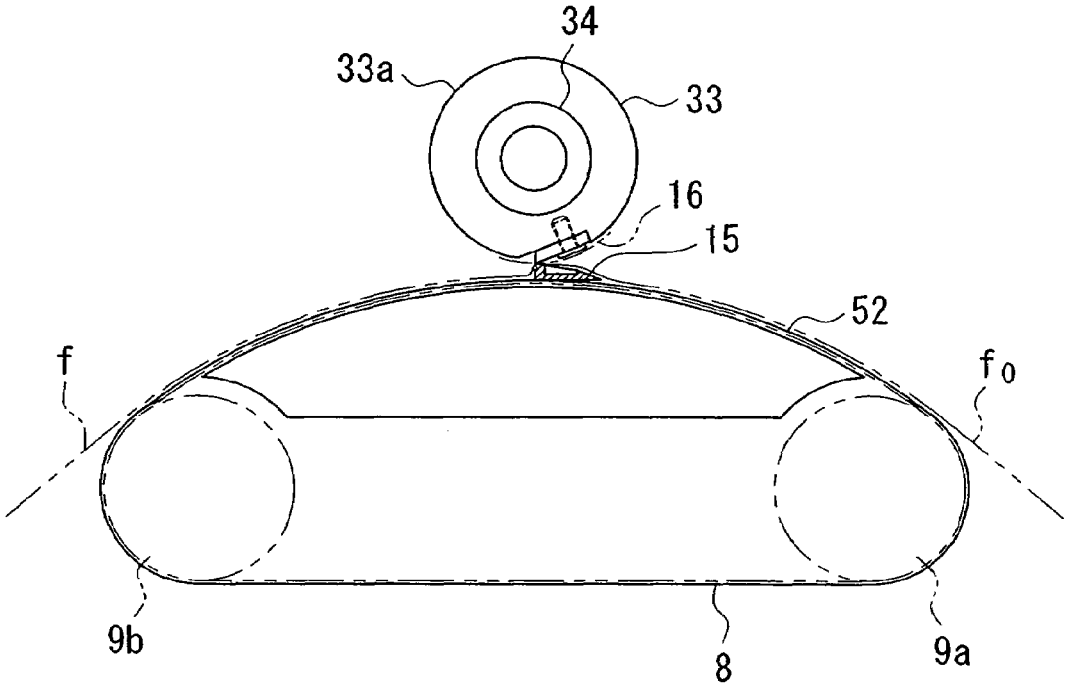
FIG. 9 is a front view of a main part showing a structure of a film cutting device according to a modification.

Next, a modification of the film cutting device 5 according to the aforementioned embodiments of the present invention will be described with reference to FIG. 9.

The adsorption type carrying belt 8 on which the cutter units 13 and 50 are disposed is not necessarily required to be planar or linear. For example, even when the top surface 52 of the adsorption type carrying belt 8 is formed to be circularly arcuately curved as shown in FIG. 9, the cutter units 13 and 50 can be disposed on the top surface 52 of the belt 8. As shown in FIG. 9, the top surface 52 of the adsorption type carrying belt 8 is formed to be circularly arcuately curved when viewed from the side. The fixed cutter 15 is disposed at an appropriate position on the top surface 52 of the adsorption type carrying belt 8 substantially along a tangential direction, and the rotary cutter 16 is disposed close to and substantially obliquely in front of the fixed cutter 15. The rotary cutter 16 is disposed along the outer peripheral surface 33*a* of the nearly cylindrical guide holder 33 in the same way as in, for example, the first embodiment. The blade edge 37 of the rotary cutter 16 performs a scissors-like cutting operation in relation to the blade edge 23 of the fixed cutter 15.

In this case, the fixed cutter 15, which has a substantially triangular section when viewed longitudinally, may be disposed at the position of the flank relief 15*b* on the forward side in the tangential direction with respect to the top surface 52 formed to be circularly arcuately curved. Alternatively, the fixed cutter 15 may be disposed at a position on the upstream side at which the inclined surface 15*a* starts being separated from the top surface 52 of the adsorption type carrying belt 8 in the tangential direction with respect to the top surface 52 of the adsorption type carrying belt 8. In any case, since the fixed cutter 15 is formed to have a maximum height of about 3 to 5 mm, the film fo can be smoothly guided to the blade edge 23 along the inclined surface 15*a*.

According to this modification, the adsorption type carrying belt 8 is great in design freedom.

In the film cutting device 45 according to the second embodiment, the film fo is cut, and an accumulation unit B is then moved up in the vicinity thereof while subjecting a film f to body folding, and is packaged with the film f. Instead, the following steps may be employed. In detail, an accumulation unit B is moved up before the film fo is cut by the cutter units, 13 and 50, and a film f that has been pushed out from the top surface 8*a* of the belt 8 is subjected to body folding. Thereafter, the fixed cutter 15 and the rotary cutters 16 and 46 cut the film fo, and the accumulation unit B is packaged with a film f.

In the embodiment described above, the vibration preventing hook 44 is pressed against the flank relief 15*b* of the fixed cutter 15. Instead of this structure, or in addition to this structure, the vibration preventing hook 44 may be disposed on a flank relief directed to the forward side in the rotational direction of the rotary cutters 16 and 46. In this case, elastically deformable toughness is provided also to the blade edge 37, as a matter of course.

Additionally, the flank relief 15*b* and the like have a runaway groove having, for example, a substantially V-shaped cross section or a concave cross section when viewed longitudinally. However, if the wedge angle of the blade edges 23 and 37 is acute, the flank relief may have a planar shape without being limited to such a V-shaped cross section or a concave cross section. In this case, it is recommended that the elastic deformation of the blade edges 23 and 37 be restricted by pressing the vibration preventing hook 44 against the flank relief.

The rotary cutters 16 and 46 are not necessarily required to be disposed at an offset position. If a tangential line of the cutter holder 33 that is drawn from the intersection of the blade edges 23 and 37 is directed to intersect with the top surface 8*a* of the belt 8 when a film is cut, a load F of the blade edge 37 will be given in a direction being applied to the fixed cutter 15.

The works accumulated and conveyed in the present invention are not limited to tissue boxes b, and may be various articles of merchandise.

INDUSTRIAL APPLICABILITY

As described above, the film cutting device of the present invention includes a first cutter that has a blade edge at an end of a guide surface inclined in a direction receding from a conveying means, and a second cutter that cuts a film on the guide surface in cooperation with the blade edge of the first cutter, and, in the film cutting device, the first cutter and the second cutter are relativity moved, and the blade edge of the first cutter and a blade edge of the second cutter are gradually engaged with each other in an extending direction thereof, thus cutting the film. Therefore, the film can be cut in the width direction by separating the film from the conveying means by use of the guide surface and by engaging the first cutter and the second cutter with each other.

Since the conveying means is an adsorption type carrying belt that adsorbs the film, the film can be carried regardless of a difference in kind, such as rigidity or tension, of the film, and the film can be cut while being adsorbed regardless of the posture of the film in which the film is carried.

Additionally, since the blade edge of the first cutter is elastically deformable, and since the first cutter is provided with a displacement restricting member that restricts an elastic deformation of the blade edge when the film is cut, an error in dimension or in installation of the first and second cutters is absorbed, and the runaway of the blade edge is restricted by the displacement restricting member even if the width of the blade edge is great. Therefore, the sharpness of the cutter can be maintained, and the film can be cut with high accuracy.

Additionally, since the first cutter is shaped like a wide band, and since the displacement restricting member is provided in a central area in an extending direction of the blade edge of the first cutter, the amount of deviation resulting from the toughness can be restricted especially in the central area where a great deformation is liable to be caused by the toughness.

Additionally, since the displacement restricting member is in contact with the flank relief of the first cutter that is crossed with the guide surface at the blade edge thereof, the toughness is secured, and a deviation caused by the toughness when the blade edges are pressed to come into contact with each other can be restricted.

Additionally, since the second cutter is a rotary cutter rotatable around a rotational shaft, and since the blade edge of the second cutter is installed so that a cutting force acts toward the first cutter when a film is cut, it is possible to absorb minute pressure-contact chaotic movement of the blade edge resulting from an error in dimension or in installation of the cutter.

Additionally, since the second cutter guides the following film in a direction of the conveying means by means of a backface of the second cutter on a rear side in a moving direction subsequent to the blade edge thereof, a film part following the film that has been cut can be guided onto the conveying means by pressing the film part down by means of the backface of the second cutter.

Additionally, since the first and second cutters are held together as a cutter unit and can be adjusted by being detached from the conveying means, an engagement position of the first and second cutters can be independently adjusted in a state in which the cutters are detached from the conveying means, and it is possible to perform excellent maintenance of the positioning of the blade edges or the replacement of constituent elements.

Additionally, since the cutter unit is disposed so as to be adjustably positioned in the direction in which the film is carried by the conveying means, the position at which the film is cut can be adjusted in forward and backward directions, and the overall device can be made compact so as to be superior in size reduction and in economy, and a cutting adjustment can be easily performed according to a difference in kind or usage of the film.

The invention claimed is:

1. A film cutting device comprising:

a conveyor for conveying a film;

a first cutter provided on the conveyor and having a blade edge at an end of a guide surface that is inclined in a direction of getting away from the conveyor; and a second cutter which is a rotary cutter rotatably around a rotational shaft, and cuts a film placed on the guide surface in cooperation with the blade edge of the first cutter, wherein the first cutter is moved backward and forward in a direction which crosses over a direction in which the film is conveyed in order to adjust a blade touching between the first cutter and the second cutter, a contact point between the blade edge of the first cutter and a blade edge of the second cutter is disposed at an offset position deviated behind a rotational direction of the second cutter with respect of a virtual reference line which is drawn in parallel with the forward and backward direction of the blade edge of the first cutter, and is drawn on the rotational shaft of the second cutter, and through a relative movement of the first cutter and the second cutter, the blade edge of the first cutter and the blade edge of the second cutter are gradually engaged with each other in an extending direction thereof in order to cut the film.

2. The film cutting device according to claim 1, wherein the conveyor is an adsorption carrying belt that adsorbs the film.

3. The film cutting device according to claim 1 or 2, wherein the blade edge of the first cutter is elastically deformable, and the first cutter is provided with a displacement restricting member that restricts an elastic deformation of the blade edge when the film is cut.

4. The film cutting device according to claim 3, wherein the first cutter is shaped like a wide band, and the displacement restricting member is provided in a central area in an extending direction of the blade edge of the first cutter.

5. The film cutting device according to claim 3, wherein the displacement restricting member is in contact with a flank relief of the first cutter crossed with the guide surface at the blade edge thereof.

6. The film cutting device according to claim 1, wherein the second cutter guides a following film in a direction of the conveyor on a rear side in a moving direction subsequent to the blade edge thereof.

7. The film cutting device according to claim 1, wherein the first cutter and the second cutter are held integrated as a cutter unit, and are removably adjusted with respect to the conveyor.

8. The film cutting device according to claim 1, wherein the first cutter and the second cutter are held integrated as a cutter unit, and the cutter unit is disposed so as to be adjustably positioned in a direction in which the film is carried by the conveyor.

* * * * *

UNITED STATES PATENT AND TRADEMARK OFFICE

CERTIFICATE OF CORRECTION

PATENT NO. : 7,325,472 B2
APPLICATION NO. : 10/542011
DATED : February 5, 2008
INVENTOR(S) : Hisamitsu Ishihara It is certified that error appears in the above-identified patent and that said Letters Patent is hereby corrected as shown below:

In Column 8, Line 14 change “rotary cutter 33” to --rotary cutter 16--.

In Column 8, Line 16 change “cutter handle 33” to --cutter holder 33--.

In Column 11, Line 49 change “the radial direction” to --the radial direction of the cutter holder 33--.

In Column 12, Line 12 change “cylindrical guide” to --cylindrical cutter--.

Signed and Sealed this

Twenty-eighth Day of July, 2009

John Doll

JOHN DOLL
*Acting Director of the United States Patent and Trademark Office*